United States Patent [19]

Cleevely et al.

[11] Patent Number: 4,724,979

[45] Date of Patent: Feb. 16, 1988

[54] RECLOSABLE, TAMPER-EVIDENT PLASTIC LID FOR A CONTAINER HAVING A CIRCULAR WALL

[75] Inventors: Bruce T. Cleevely; Harry M. George, both of Pittsburgh, Pa.

[73] Assignee: Acorn Technology Inc., Pittsburgh, Pa.

[21] Appl. No.: 46,210

[22] Filed: May 5, 1987

[51] Int. Cl.[4] ..... B65D 51/22

[52] U.S. Cl. ..... 220/258; 220/270; 220/307; 220/339

[58] Field of Search ..... 220/266, 270, 276, 307, 220/258, 339; 215/235, 237

[56] References Cited

U.S. PATENT DOCUMENTS 3,282,477 11/1966 Henchert ..... 220/258
3,434,620 3/1969 Laurizio ..... 220/258
4,059,201 11/1977 Foster ..... 220/258
4,533,062 8/1985 Krautkramer ..... 220/258

*Primary Examiner*—George T. Hall
*Attorney, Agent, or Firm*—Parmelee, Miller, Welsh & Kratz

[57] ABSTRACT

A tamper-evident, reclosable, integral rigid plastic lid for use on a container having an upper circular wall provides a double seal for the container contents until opened by a user and a single seal thereafter. The lid has a circular base, with a recess therein and a rupturable planar member extending across the recess, and a hinged closure member secured to a platform which completely covers the recess. The platform is in the shape of a segment of the circle formed by the circular base with a downwardly extending face provided along a chord of the circle which, with an arcuate raised rim about the circular base forms the bounds of the recess.

10 Claims, 7 Drawing Figures

RECLOSABLE, TAMPER-EVIDENT PLASTIC LID FOR A CONTAINER HAVING A CIRCULAR WALL

CROSS-REFERENCE TO RELATED APPLICATIONS

The present application is related to the following three co-pending applications of the present inventors filed on even data herewith: "Tamper-Evident, Reclosable, Plastic Lid"; "Plastic Container with Integral Tamper-Evident Reclosable Lid"; and "Method of Molding Rigid Plastic Members Having a Tear Element".

The present invention relates to a lid for a cylindrical container, the lid formed completely from a relatively rigid plastic material, such as polypropylene, and having a tear-away portion, with an integral closure member or cap that seals the container after the tear-away portion of the lid has been removed.

Numerous attempts have been made to provide lids for containers such as those which contain foodstuffs, coffee, nuts and the like, which are tamper-evident and which can be resealed once the container contents have been exposed. A prevalent such system, at present, comprises a container formed from a metal, such as aluminum, which has a tear-away metal lid and a separate supplemental plastic cover for resealing the container once the tear-away metal lid has been removed. A reason for using a metal lid in such a combination container closure is the property of the metal to resist oxygen permeability and moisture transfer from the atmosphere to the container contents. Such dual closure systems are however expensive. Also, a problem exists of the consumer cutting a hand on the sharp metal edges of the tear-away metal lid or the rim of the container upon removal of the lid.

While some lids have been suggested that are formed from solely a plastic material, such lids are usually fromed from polyethylene which is easy to mold and which can be provided with a tear-away portion. A lid formed from polyethylene, however, does not provide the desired high resistance to moisture passage from the atmosphere to the contents of the can or from the contents of the can out of the container to the atmosphere. Such polyethylene material similarly do not provide the desired resistance to oxygen permeability through the container. Also, since polyethylene is a relatively pliable material, a possibility exists for removal of the polyethylene lid and resecurement thereof on a container, which thus does not provide the requisite tamper-evident feature desired.

Polypropylene and other more rigid types of thermoplastic material would be highly desirable in forming container closures but such materials are more difficult to mold and especially difficult to mold into a shape that would provide a weakened tear line.

In U.S. Pat. No. 3,499,572, an easy-opening lid structure has a tear portion and a remaining portion welded together along a rupturable weld line of fused material of both portions. A sequential molding process is described for use in forming the lid, where two confronting movable mold bodies are closely spaced to define two separated lid portions with a small gap therebetween and, after molding of the two separated lid portions, the confronting mold bodies are moved slightly apart due to pressure buildup, and the gap is filled with plastic to connect the two lid portions together by a tearable weld line. The plastic material is said to flash across the gap to form a fused or merged weld line.

In U.S. Pat. No. 4,448,324, a container closure is described which is formed by a sequential molding process and a weld zone is formed between two molded portions. The method involves sequentially molding two parts, with injection molding of the second part carried out so that the molecule chains of the plastic material essentially are broken in the weld zone and/or so that the temperature of the plastic material in the first and second parts is maintained at a lower level than required for complete fusing together. The sequential molding process is used to make container closures with a tear-out portion and preferably closures of a composite type where a thin metal foil and plastic material composite is used.

To our knowledge, no tamper-evident polypropylene lid has been made commercially available wherein a lid has a tear-away portion to act as a tamper-evident feature and also has an integrally formed reclosable lid section.

It is an object of the present invention to provide an integral tamper-evident and reclosable lid for a cylindrical container that has a tear-away portion and integral reclosable member, which is formed from propylene or other such rigid polymeric material.

SUMMARY OF THE INVENTION

An integral lid for a cylindrical container has a circular base, with a double seal initially provided comprising a removable planar member disposed in a recess in the circular base and an integrally hinged closure member overlying the removable planar member. After removal of the planar member, the lid still provides a seal for the contents of the container through the closure member.

The circular base of the lid has an upper edge and a linear wall portion thereon, with a raised platform provided on the base, the platform being in the shape of a segment of the circle formed by the circular base. A downwardly extending face is provided on the platform along a chord of the circle, with the downwardly extending face parallel to the linear wall portion of the base. The circular base also has an arcuate raised rim thereabout with an inner wall thereon which merges with the linear inner wall to form a recess, which recess is closed by the planar member that has a rupturable portion. Removal of the rupturable portion of the planar member allows access to the contents of the cylindrical container with the lid secured thereto. The integral hinged closure member is secured to the platform and completely covers the recess, with the planar member therein, and also preferably the arcuate raised rim. Locking means are provided to secure the closure member to the arcuate raised rim so as to seal the container, initially when the planar member is intact to provide a double seal, and also after the planar member has been removed to seal the contents of the container from the atmosphere.

DETAILED DESCRIPTION

Figure 1:
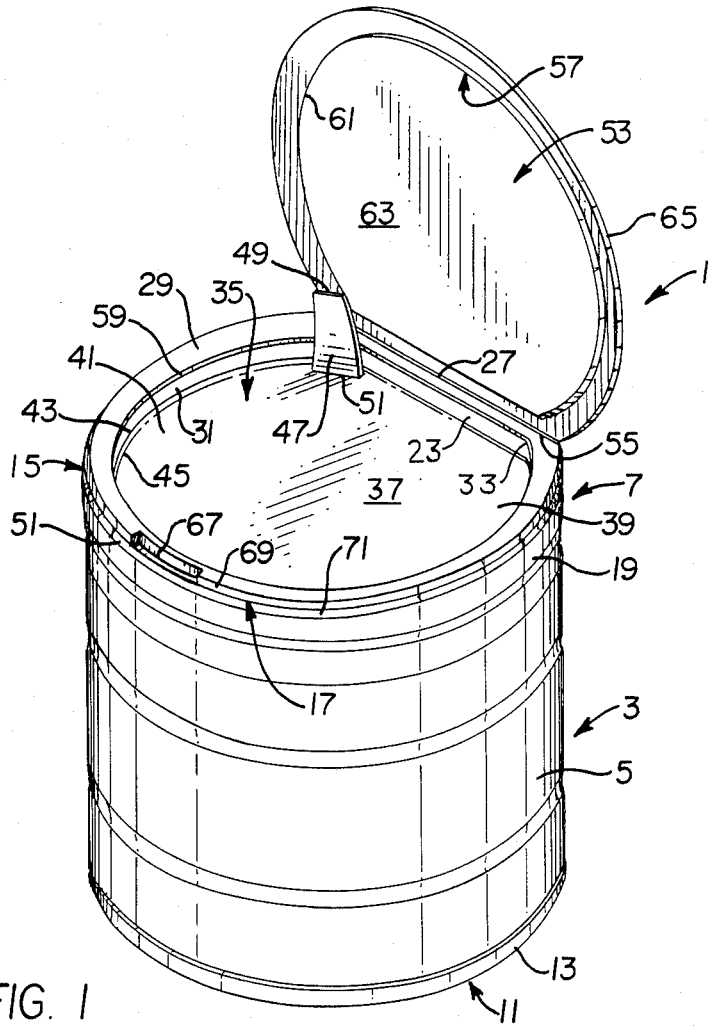
FIG. 1 is a perspective view of the lid of the present invention secured to a cylindrical container with the closure member in raised position and the planar member thereof intact.

The present plastic lid for use in sealing cylindrical containers is formed from a rigid plastic so as to provide stiffness to resist unauthorized removal and replacement of the lid and has oxygen and moisture barrier properties to seal the contents of the container from the atmosphere.

The lid is preferably made from a polypropylene homopolymer, copolymers thereof having up to about 6 percent of a comonomer such as ethylene, and preferably less than about 3 percent of such a comonomer, or ethylene and a termonomer such as butene -1, pentene -1 or hexene -1, the total thereof being less than about 6 and preferably less than 3 percent may be used. Also, other plastics having the desired properties may be used, such as a nylon polymer such as nylon 6 or nylon 6/6, a polymethyl pentene polymer, or a polycarbonate.

The plastic that is used in the present invention is one having sufficient oxygen and moisture barrier properties, as well as environmental stress crack resistance. The plastic should have sufficient stiffness yet possess properties for formation of a hinge integral between the closure member and wall section. The tensile modulus of such a plastic material should be in excess of about $100\times10^3$ p.s.i. ( pounds per square inch) according to ASTM D638, and the flexural modulus in excess of about $100\times10^3$ p.s.i. according to ASTM D790, while the melting point or glass transition temperature should be in excess of about 140° C.

By use of a plastic having a tensile modulus and flexural modulus in excess of about $100\times10^3$ p.s.i., a rigid lid is provided that resists flexing of the walls of the lid sufficient to remove the lid from the container and possibly replace the same without indication to a prospective purchaser or user of the container having the lid. A glass transition temperature or melting point of about 140° C. or more of the plastic used also inhibits heating of the lid for softening and possible removal and replacement.

In addition, the plastic must have environmental stress crack resistance to prevent damage to the lid by oils or vapors from the contents of the container, as well as oxygen and moisture impermeability, sufficient to provide a desired shelf life for the contents of a container upon which the lid is used.

An embodiment of the lid of the present invention is illustrated in FIGS. 1 to 7. The lid 1 is illustrated engaged with a cylindrical container 3 having a circular wall 5 in FIG. 1, the circular wall 5 having an upper edge 7 thereon, the upper edge having an engagement means such as a curved end or inverted J-shaped edge 9. Other engagement means, such as a lip or other means may also be used. The bottom 11 of the can 3 may be recessed slightly to provide a downwardly extending rim 13 for stacking purposes.

The lid 1 has a circular base 15 with means 17 thereon for securing the circular base to the container 3. As illustrated, the securing means can comprise a pair of downwardly depending spaced skirts 19, 19', skirt 19 being an outer skirt depending from the periphery of the circular base, and skirt 19' being an inner skirt spaced therefrom to allow placement of the lid on the container 3 with the upper edge 7 secured therebetween through engagement of the curved end 9 with a rib 21 on the inner skirt 19' facing outer skirt 19.

The circular base 15 has a linear inner wall 23 along a portion thereof, and a raised platform 25 thereon, the platform in the shape of a segment of the circle formed by the circular base, which platform 25 is provided with a downwardly extending face 27 along a chord of the circle formed by the circular base. The circular base 15 also has an arcuate raised rim 29, about the circular base, having an arcuate inner wall 31, that merges, as at 33, with the linear inner wall 23 so as to form a recess 35 in the lid 1. The recess 35, as illustrated, is bounded by the linear inner wall 23, and the arcuate inner wall 31 of the raised rim 29, with the downwardly extending face 27 of the platform 25 parallel to the linear inner wall 23.

Extending across the recess 35 is a planar member 37, the planar member sealing the recess. The planar member 37 has a rupturable portion 39 which enables removal of said portion and access to the contents of the container to which the lid 1 is secured. The planar member 37 preferably comprises a central section 41 bounded by a peripheral section 43, with the two sections integrally connected through a tear line 45. The tear line 45 is formed as a weld line between the two supplies of plastic used to form the central section and peripheral section. A gripping member, such as a pull tab 47, is provided on the central section 41, adjacent the tear line 45, to enable the user to grip the gripping member and tear away the central section 41 of the planar member and provide an opening O for access to the contents of the container 3. The pull tab is integrally molded with the planar member 37 and has a free end 49, opposite the end 51 thereof attached to the planar member. The pull tab 47 is illustrated as exposed, but if desired, the same could be disposed in an adjacent depression or well (not shown) formed in the central portion 41 of the planar member 37.

Figure 2:
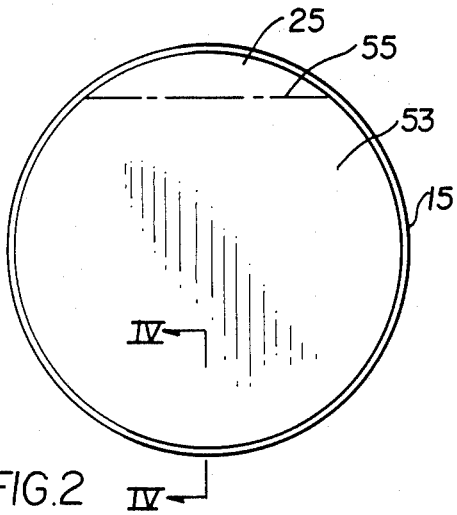
FIG. 2 is a top plan view of the lid of the present invention with the closure member in locked position.
Figure 3:
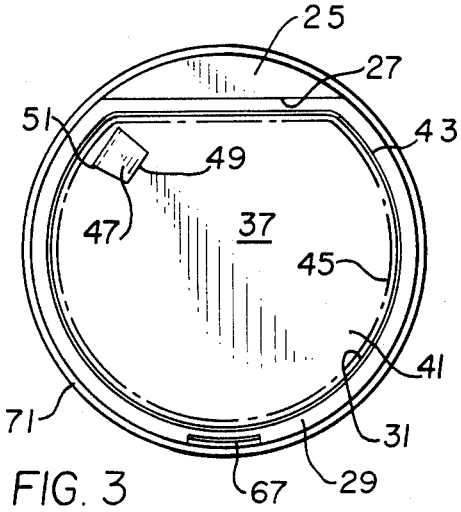
FIG. 3 is a top plan view of the lid, with the closure member removed for clarity, showing the raised platform and arcuate rim with the planar member intact.
Figure 4:
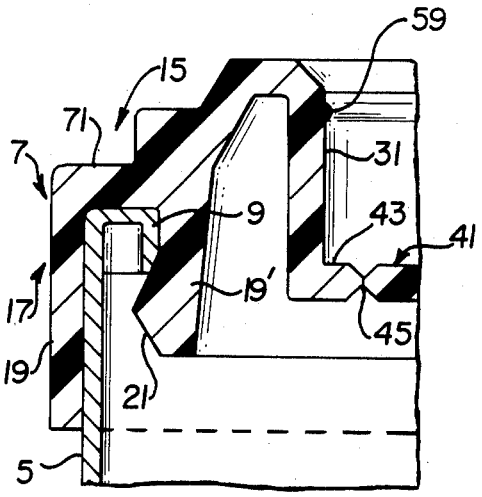
FIG. 4 is a view taken along the lines IV—IV of FIG. 2 showing the lid secured to the upper edge of the circular wall of the container with the closure member in opened position.

An integral closure member 53 is provided on the lid 1, the closure member secured to the platform 25, adjacent the downwardly extending face 27 thereof, through an integral hinge 55. The closure member 53 is adapted to completely cover the recess 35 and the planar member 37, and preferably also covers the arcuate raised rim 29, as shown in FIG. 2.

A locking means 57 is provided to lock the closure member to the arcuate raised rim 29 and seal the container after removal of the rupturable portion 39 of the planar member 37. As illustrated, the locking means 57 can comprise an inwardly directed bead 59 along the inner wall 31 of the arcuate raised rim 29, and a coacting downwardly and outwardly directed flap 61 depending from the bottom wall 63 of closure member 53. To provide additional locking and sealing, a depending flange 65 may be provided about the periphery of the closure member such that, when in closed position, the arcuate raised rim 29 is frictionally secured between flap 61 and flange 65 of the closure member 43.

A depression 67 may be provided in the outer surface 69 of raised arcuate rim 29 for insertion of a user's fingertip to lift the closure member 53 from locked position. Also, the raised arcuate rim 29 is preferably spaced slightly inwardly from the periphery of the circular base 15 to provide a ledge 71 for stacking of container 3 with lids 1 one atop the other for shipment and storage, with the recessed bottom of an uppermost container resting on the closure member 53 of a lower container and the rim 13 resting on the circular base 15.

Figure 6:
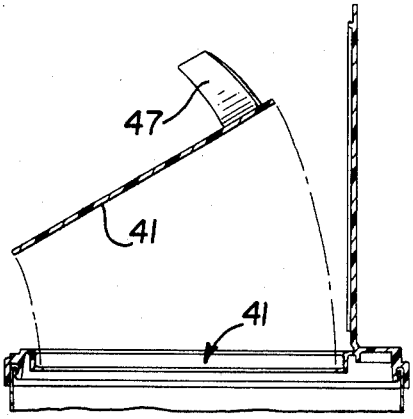
FIG. 6 is a schematic cross-section of the lid with the planar member being removed to provide access to the content of a container.
Figure 5:
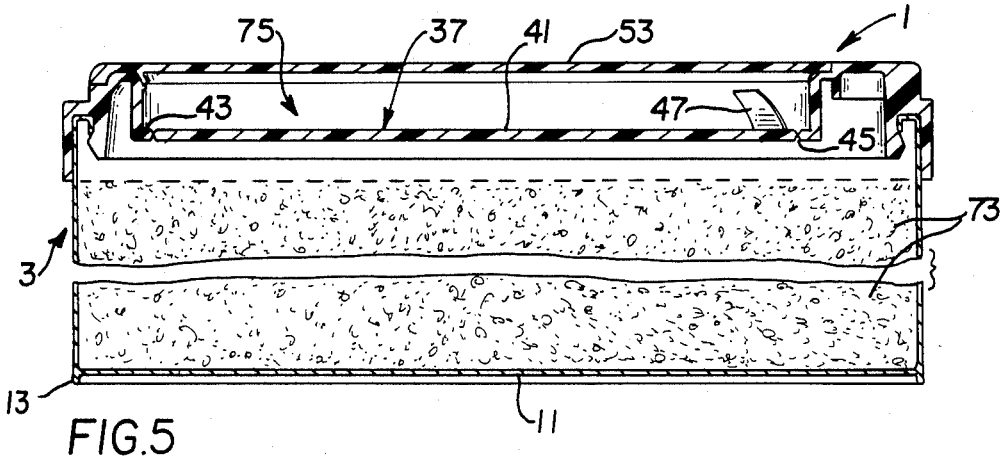
FIG. 5 is a vertical cross-sectional view of the lid secured to a container showing the double seal for the contents of the container by the planar member and the closure member.

As illustrated in FIG. 5, the contents 73 of the contents 3 having the lid 1 secured thereto, are sealed relative to the atmosphere outside the container by a double seal provided by the planar member 37 and the closure member 53, with a gap 75 therebetween also providing an air space or buffer zone between the contents of the container and the atmosphere. The planar member 37 also provides a tamper-evident feature for the lid, since the purchaser will know that the contents have been exposed if the tear line 45 is not intact. Upon removal of the rupturable portion 41 of the planar member, as illustrated in FIG. 6, the user then has access through the opening O, to the contents of the container.

Figure 7:
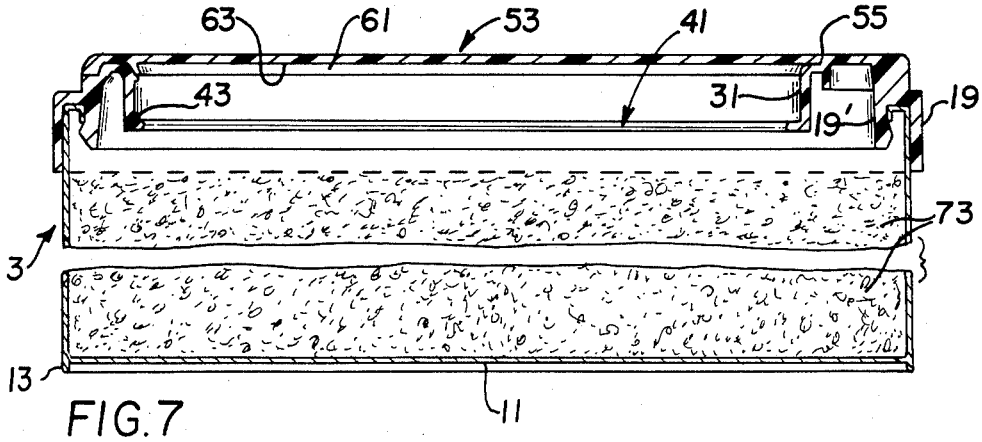
FIG. 7 is a vertical cross-sectional view of the lid secured to a container after the planar member has been removed, but with the closure member in locked position to seal the contents of the container from the atmosphere.

Once the rupturable portion 41 of the planar member has been removed, the lid still provides a seal for the contents relative to the atmosphere through the closure member 53, as illustrated in FIG. 7.

In many instances, it is important that the access opening O to the contents of the can be as large as possible, such as in instances where the user is to reach into the can with fingers to grasp and remove the contents. It is thus an embodiment of the present invention that the opening O for access to the contents of the container have an area equal to at least 80 percent of the area of the circle formed by the circular base of the lid.

The planar member 37 of the circular lid 1 could preferably have a thickness of about 0.030 to 0.040 in the cenral and peripheral portions 41, 43, with a tear or weld line 45 dimension being critical. The weld line must have a thickness of between 0.002 to 0.007 inch, with a width of between 0.001 to 0.25 inch. A thickness of less than about 0.002 inch is unusable because the flow of polypropylene into the weld line area cannot be effected, while a thickness greater than about 0.007 provides a weld line that is too difficult to tear and/or leaves undesirable jagged edges along the tear line. A correlation exists between the thickness and width of the weld line in that the larger the thickness of the weld line in the range that is used, the larger the width of the weld line, within the respective range, that is required, i.e., a weld line of about 0.007 inch thick would require a width of about 0.025 inch, while a thickness of about 0.002 inch requires a width at the lower range thereof, or about 0.001 inch. The thickness t of the closure member 53 would be about 0.030 to 0.040 inch, with the hinge 55 having a thickness of about 0.008 to 0.012 inch, preferably 0.010 inch. The hinge 55 cannot be less than about 0.008 in thickness since flow across the section of the mold cavity to form the hinge and subsequently the closure member is very difficult, while a hinge thickness of greater than about 0.012 inch would not provide the requisite pliability and hinge action needed.

The present lid thus provides a tamper-evident, reclosable lid for a cylindrical container that provides a double seal for the container contents until opened, and a single seal therefor after opening of the container by a user.

What is claimed is:

1. A lid, for a cylindrical container having a circular wall with an upper edge thereon, said lid comprising:

a circular base, a portion of the circular base having a linear inner wall;

means for securing said circular base to said container a raised platform on said base, in the shape of a segment of the circle formed by said circular base, providing a downwardly extending face along a chord of said circle;

an arcuate raised rim, having an arcuate inner wall, about the circular base which merges with said linear inner wall to form a recess bounded by said linear inner wall and said arcuate inner wall of the arcuate raised rim;

a planar member extending across said recess;

a rupturable portion on said planar member allowing access to the contents of the cylindrical container when the lid is engaged therewith and said rupturable portion removed;

an integral closure member hingedly secured to said platform adapted to completely cover said recess, and said planar member therein;

locking means securing said closure member to said arcuate raised rim to lock said closure member and seal said container when said planar member is intact and also after removal of said rupturable portion of the planar member; and said lid formed from a plastic material having a tensile modulus in excess of about $100\times10^3$ p.s.i., a flexural modulus in excess of about $100\times10^3$ p.s.i., and a melting point in excess of 140° C.

2. A lid as defined in claim 1 wherein said means for securing said circular base to said container comprises a pair of downwardly depending spaced circular skirts on said base for engagement with the upper edge of said circular wall.

3. A lid as defined in claim 1 wherein said integral closure member also covers said arcuate raised rim.

4. A lid as defined in claim 1 wherein said rupturable portion on said planar member is sized so as to provide, when removed from said lid, an opening for access to said container which is at least 80 percent of the area of the circle formed by said circular base.

5. A lid as defined in claim 1 wherein the rupturable portion on said planar member comprises a central portion bounded by an outer peripheral portion, and a tear line formed as a weld line, formed intermediate said central and peripheral portions.

6. A lid as defined in claim 1 wherein the same is formed completely of polypropylene.

7. A lid as defined in claim 1 wherein said rupturable portion of said planar member has a pull tab integrally molded with the upper surface thereof.

8. A lid as defined in claim 1 wherein said locking means comprises a downwardly and outwardly directed flap provided on the bottom wall of the closure member which coacts with an inwardly directed bead along the inner wall of the arcuate raised rim.

9. A lid as defined in claim 8 wherein a depending flange is provided about the periphery of the closure member such that, when in closed position, the arcuate raised rim is frictionally secured between said flap and said flange.

10. A lid, for a cylindrical container having a circular wall with an upper edge thereon, said lid comprising:

a circular base, a portion of the circular base having a linear inner wall;

means for securing said circular base to said container a raised platform on said base, in the shape of a segment of the circle formed by said circular base, providing a downwardly extending face along a chord of said circle;

an arcuate raised rim, having an arcuate inner wall, about the circular base which merges with said linear inner wall to form a recess bounded by said linear inner wall and said arcuate inner wall of the arcuate raised rim;

a planar member extending across said recess;

a rupturable portion on said planar member comprising a central portion bounded by an outer peripheral portion, a tear line formed as a weld line, formed intermediate said central and peripheral portions, and a pull tab is integrally molded with the upper surface of said central portion, allowing access to the contents of the cylindrical container when the lid is engaged therewith and said rupturable portion removed;

an integral closure member hingedly secured to said platform adapted to completely cover said recess, said planar member therein and said arcuate raised rim;

locking means securing said closure member to said arcuate raised rim to lock said closure member and seal said container when said planar member is intact and also after removal of said rupturable portion of the planar member; and said lid formed from a plastic material having a tensile modulus in excess of about $100\times10^3$ p.s.i., a flexural modulus in excess of about $100\times10^3$ p.s.i., and a melting point in excess of 140° C.

* * * * *